US008585516B1

(12) United States Patent
Buono et al.

(10) Patent No.: US 8,585,516 B1
(45) Date of Patent: Nov. 19, 2013

(54) BALL HITTING PRACTICE DEVICE AND BALL

(71) Applicants: Ronald Buono, New York, NY (US); Eric Buono, New York, NY (US)

(72) Inventors: Ronald Buono, New York, NY (US); Eric Buono, New York, NY (US)

( * ) Notice: Subject to any disclaimer, the term of this patent is extended or adjusted under 35 U.S.C. 154(b) by 0 days.

(21) Appl. No.: 13/755,995

(22) Filed: Jan. 31, 2013

(51) Int. Cl.
*A63B 69/00* (2006.01)

(52) U.S. Cl.
USPC ..... 473/423; 473/430; 473/422

(58) Field of Classification Search
USPC ..... 473/428, 423, 422, 429, 430, 142, 431
See application file for complete search history.

(56) References Cited

U.S. PATENT DOCUMENTS

| | | | | | |
|---|---|---|---|---|---|
| 1,240,168 | A | | 9/1917 | Bhisey | |
| 2,134,451 | A | | 10/1938 | Mogren | |
| 2,323,624 | A | | 7/1943 | Schall | |
| 2,765,170 | A | * | 10/1956 | Brown | 473/424 |
| 3,006,647 | A | | 10/1961 | Haskett | |
| 3,194,557 | A | | 7/1965 | Holley | |
| 3,310,306 | A | | 3/1967 | Burt | |
| 3,380,738 | A | | 4/1968 | Papp | |
| 3,397,885 | A | | 8/1968 | Nash | |
| 3,454,275 | A | | 7/1969 | Pontone | |
| 3,529,823 | A | | 9/1970 | Garver | |
| 3,623,725 | A | | 11/1971 | Setten, Sr. | |
| 3,893,669 | A | | 7/1975 | Myers | |
| 4,022,467 | A | * | 5/1977 | Ruess | 473/464 |
| 4,042,237 | A | * | 8/1977 | Moraru | 473/429 |
| 4,079,934 | A | | 3/1978 | Nixon | |
| 4,191,372 | A | | 3/1980 | Keller | |
| 4,216,960 | A | | 8/1980 | Nicholls | |
| 4,322,075 | A | | 3/1982 | Hynes | |
| 4,352,494 | A | * | 10/1982 | Wells | 473/449 |
| 4,460,172 | A | * | 7/1984 | Hogan | 473/426 |
| 4,462,599 | A | | 7/1984 | Brown | |
| 4,502,684 | A | | 3/1985 | Rocha | |
| 4,508,339 | A | * | 4/1985 | Llewellyn | 473/429 |
| 4,706,964 | A | | 11/1987 | Genovese | |
| 4,846,472 | A | * | 7/1989 | Terza | 473/424 |
| 4,865,319 | A | | 9/1989 | Drazinakis | |
| 4,898,385 | A | | 2/1990 | Love | |

(Continued)

OTHER PUBLICATIONS

Ez Htz Sports, Trainer, http://www.ezhtzsports.com/Home_Page.html, printed Jan. 25, 2013, date of last modification unknown—2 pages.

(Continued)

*Primary Examiner* — Mitra Aryanpour
(74) *Attorney, Agent, or Firm* — Brad M. Behar & Associates, PLLC

(57) ABSTRACT

The present invention is a device to be used to practice hitting a ball. The device according to the invention suspends a ball at a variety of positions movable along three axes. The ball is removably connected to a flexible line having a first side magnet thereon. The user can select if the first-end magnet will rise or fall when the removable ball is struck and the first-end magnet is hit and/or swings a predetermined amount by using two of three alternative ways to connect a connector on a second-side of the flexible line, either a counterweight or a connector-magnet attached to an adjustment peg fixedly attached to a vertical support. The present invention is also the ball having metallic components inside which can be safely used with or without the device. The device is safer than existing devices and it produces better results due to its configuration.

18 Claims, 7 Drawing Sheets

(56) References Cited

U.S. PATENT DOCUMENTS

| | | | | | |
|---|---|---|---|---|---|
| 4,907,801 | A | * | 3/1990 | Kopp | 473/423 |
| 4,993,709 | A | * | 2/1991 | Tominaga | 473/430 |
| 5,011,143 | A | | 4/1991 | Jones | |
| 5,048,828 | A | | 9/1991 | Love | |
| 5,158,517 | A | | 10/1992 | Steggert | |
| 5,184,816 | A | * | 2/1993 | Lunsford | 473/427 |
| 5,255,911 | A | | 10/1993 | Preston et al. | |
| 5,282,615 | A | | 2/1994 | Green et al. | |
| 5,338,026 | A | | 8/1994 | Kregel | |
| 5,374,056 | A | | 12/1994 | Scher et al. | |
| 5,386,986 | A | | 2/1995 | Gamboa | |
| 5,389,063 | A | * | 2/1995 | Wu | 601/135 |
| 5,417,631 | A | | 5/1995 | Brown et al. | |
| 5,452,888 | A | * | 9/1995 | Glenn | 473/424 |
| 5,454,561 | A | | 10/1995 | Smith | |
| 5,467,978 | A | | 11/1995 | Paluch | |
| 5,480,141 | A | | 1/1996 | Wood | |
| 5,503,389 | A | * | 4/1996 | Campbell | 473/430 |
| 5,531,438 | A | | 7/1996 | Corley | |
| 5,540,430 | A | | 7/1996 | Nichols et al. | |
| 5,553,848 | A | * | 9/1996 | Amron | 473/416 |
| 5,605,326 | A | * | 2/1997 | Spear, Jr. | 473/422 |
| 5,634,872 | A | | 6/1997 | Brown et al. | |
| 5,665,017 | A | | 9/1997 | Walters | |
| 5,681,168 | A | | 10/1997 | Brown | |
| 5,683,315 | A | | 11/1997 | Ring | |
| 5,713,805 | A | | 2/1998 | Scher et al. | |
| 5,743,820 | A | | 4/1998 | Espinosa et al. | |
| 5,746,667 | A | | 5/1998 | Fraser et al. | |
| 5,755,630 | A | | 5/1998 | Malwitz | |
| 5,788,589 | A | | 8/1998 | Koo et al. | |
| 5,820,495 | A | | 10/1998 | Howland | |
| 5,836,836 | A | | 11/1998 | Grimes | |
| 5,853,334 | A | * | 12/1998 | Winebrenner | 473/142 |
| 5,882,270 | A | | 3/1999 | Daugherty | |
| 5,913,739 | A | | 6/1999 | Brenneisen | |
| 6,099,419 | A | | 8/2000 | Incaudo et al. | |
| 6,334,821 | B1 | * | 1/2002 | Kita | 473/430 |
| 6,390,939 | B1 | * | 5/2002 | Palacios | 473/422 |
| 6,458,037 | B1 | * | 10/2002 | Dixon, Jr. | 473/219 |
| 6,575,852 | B2 | * | 6/2003 | Orner | 473/438 |
| 6,672,979 | B2 | | 1/2004 | Brenneisen | |
| 6,716,119 | B1 | * | 4/2004 | Weisz et al. | 473/423 |
| 6,729,978 | B2 | | 5/2004 | Moss et al. | |
| 6,790,150 | B1 | | 9/2004 | Moss et al. | |
| 7,115,051 | B2 | | 10/2006 | Hansberry | |
| 7,115,052 | B2 | | 10/2006 | Wardle et al. | |
| 7,186,193 | B1 | | 3/2007 | McFadden, Jr. | |
| 7,198,579 | B2 | | 4/2007 | Moss et al. | |
| 7,223,186 | B2 | | 5/2007 | Tresvant | |
| 7,226,373 | B2 | * | 6/2007 | Arenas | 473/417 |
| 7,775,911 | B2 | * | 8/2010 | Zappel et al. | 473/422 |
| 7,775,913 | B2 | | 8/2010 | Woods | |
| 8,033,934 | B1 | | 10/2011 | Clancy | |
| 8,137,218 | B2 | * | 3/2012 | Le niewicz | 473/430 |
| 2005/0003908 | A1 | | 1/2005 | Smull et al. | |
| 2005/0137034 | A1 | * | 6/2005 | Wilson | 473/423 |
| 2006/0035730 | A1 | * | 2/2006 | Nguyen | 473/417 |
| 2006/0105862 | A1 | * | 5/2006 | Jennings | 473/423 |
| 2007/0100468 | A1 | * | 5/2007 | Yun | 700/1 |
| 2009/0082140 | A1 | * | 3/2009 | Liao | 473/417 |
| 2009/0239686 | A1 | | 9/2009 | Moos | |
| 2011/0165969 | A1 | | 7/2011 | Gu | |
| 2012/0040782 | A1 | * | 2/2012 | Grabner | 473/423 |
| 2012/0225740 | A1 | * | 9/2012 | Gibadlo | 473/423 |

OTHER PUBLICATIONS

Rod Carew Baseball Gap Hitter, http://www.walmart.com/ip/Rod-Carew-Baseball-Gap-Hitter/15730106m, printed Jan. 25, 2013, date of publication unknown—1 page.

SKLZ Tee Baseball and Softball Batting Tee, http://www.sears.com/search=SKLZ Tee Baseball and Softball Batting T . . . , printed Jan. 29, 2013, date of publication unknown—6 pages.

SKLZ Hurricane Category 4 vs SwingAway MVP, http://www.swing-smarter-baseball-hitting-drills.com/sklz-hurricane-cate . . . , printed Jan. 29, 2013,date of publication unknown—6 pages.

* cited by examiner

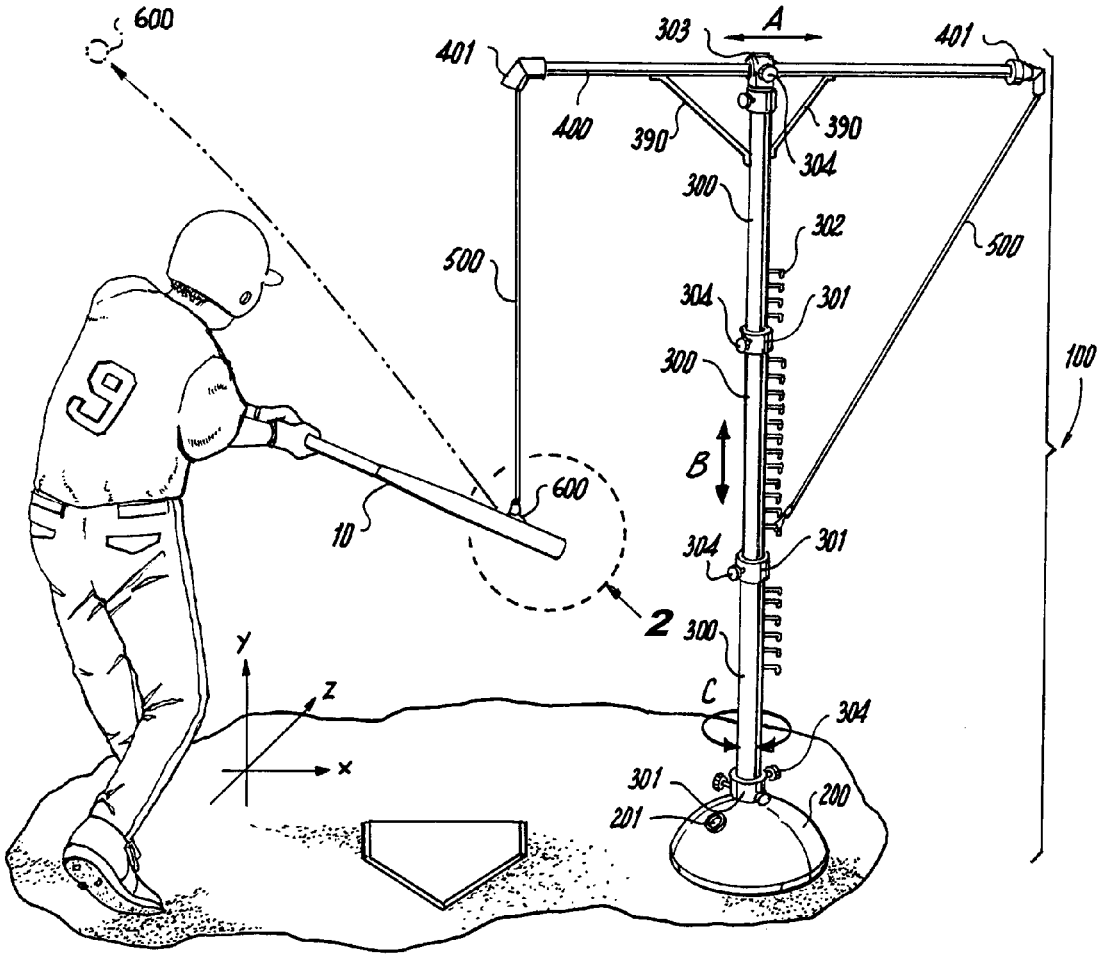
Fig. 1
Fig. 2
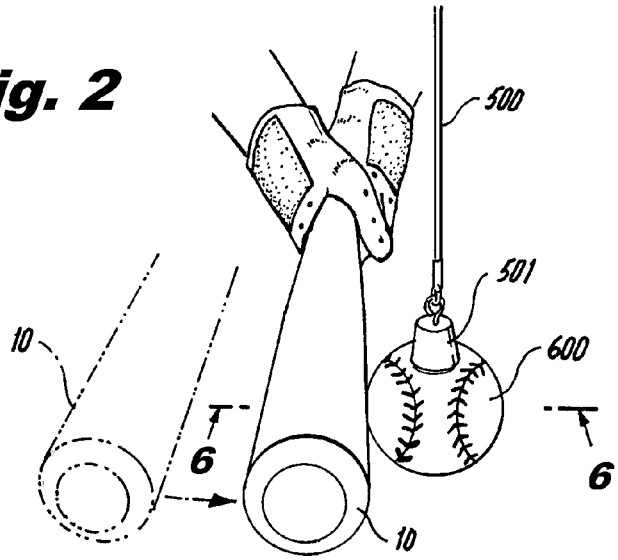

2/7
304
304
A
401
400
303
401
500
5
304
301
302
501
600
304
301
200

4a
400
402
A
304
4a
402
403
500

500
400
500
501
402

600
500
302
300
502
503

Fig. 8
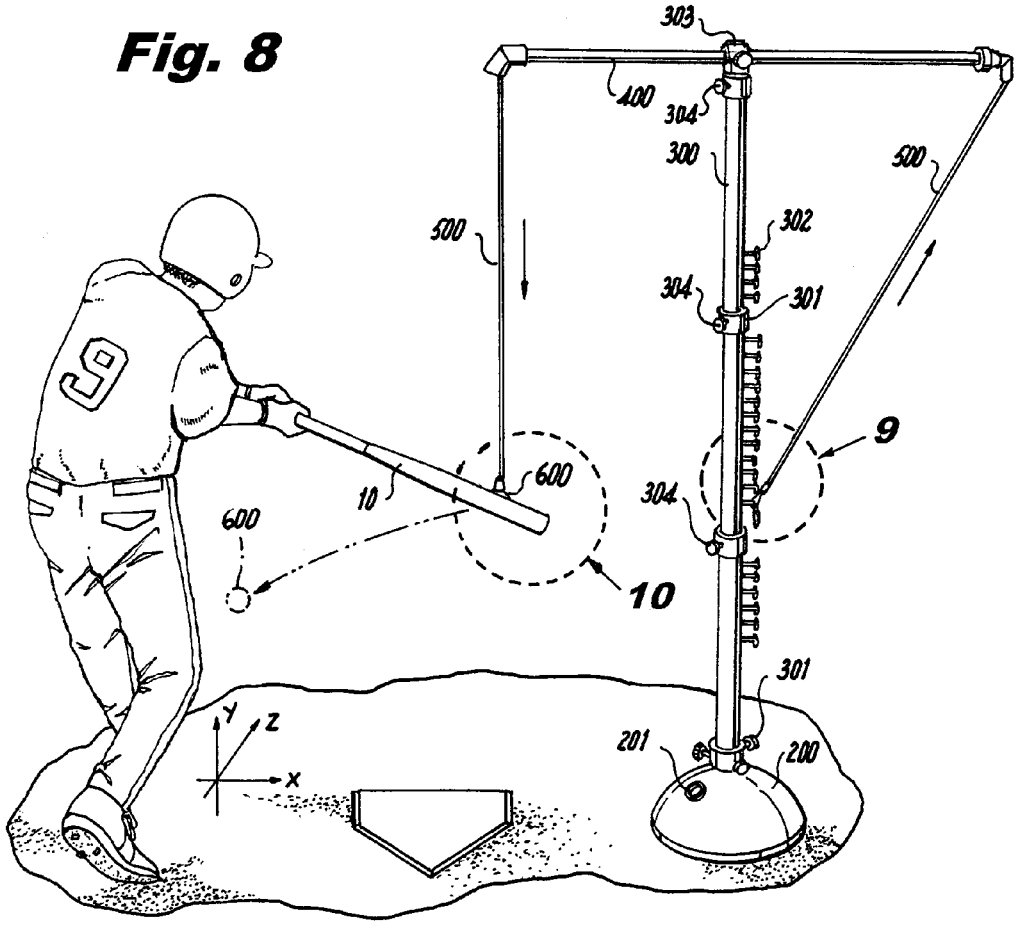
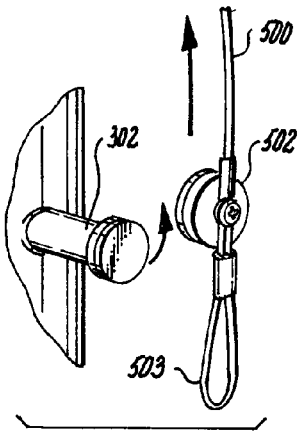
Fig. 9
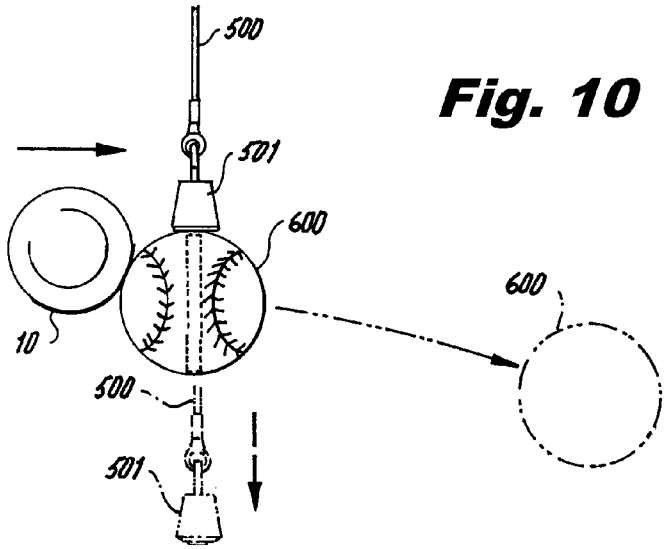
Fig. 10

BALL HITTING PRACTICE DEVICE AND BALL

FIELD OF THE INVENTION

The present invention relates generally to training devices to practice hitting balls, such as a baseball, from a stationary position. The present invention also relates to portable devices used to practice hitting a suspended and releasable ball that produces better results than existing devices/technologies. The present invention further relates to balls containing metallic components that are releasably connected to a magnet and usable with the training device of the invention and which are safe to field and throw despite having metal inside them.

BACKGROUND OF THE INVENTION

Sports such as baseball, softball, cricket, stickball, tennis, paddleball, ping pong, etc. involve striking a ball using an apparatus such a bat, a racket, or a paddle. As for most sports, the player is trying to produce the best result possible, that is, hitting the ball in the preferred direction and location and with the desired amount of force and speed. Being expert at hitting the ball and improving one's ability to hit, particularly for baseball, requires practice.

Many different types of training devices have been developed over the years to help players become more skilled with the act of hitting. For baseball, for example, the most common practice device presently used for hitting is the hitting tee. The hitting tee is a stationary stand usually made of plastic tubes on which the baseball sits. The height of the hitting tee, and thus the ball when it is on the hitting tee, is usually adjustable, to some extent, based on the configuration of the tee base and stand. Most conventional hitting tees are constructed to have a minimum height formed by a first stand tube and a maximum height formed by a second stand tube slidably mounted on or within the first stand tube. The bottom of the first stand tube is typically mounted in a hole or opening in the base usually in the shape of home plate. In some conventional hitting tees, there are several (e.g., four or five) holes in which the first stand tube can be placed to vary the location of the ball, to some degree, on the stand with respect to the base (home plate).

Some of the major flaws of a hitting tee are that the positioning of the ball with respect to the plate and the player is limited to a finite number of heights and locations due to the component parts and it is very common for the player to hit the tee when striking the ball decreasing the effectiveness of the device and the practice. When using a hitting tee a player cannot adequately hit the bottom half of the baseball to lift the ball because the hitting tee is in the way. The swing may have been the preferred swing but the trajectory of the ball and the follow through were not desirable due to the bat striking the tee. The user would not know that the swing was a good swing because he/she struck the tee or the ball did not travel in its normal trajectory. Other drawbacks with hitting tees are they can be visually distracting to the hitter causing the player to alter the swing, hit the ball on a different part (e.g., off center) to avoid striking the tee, and/or creating bad habits during practice for the hitter.

There are training devices that do not use any ball and seek to teach the player to swing a bat in a certain manner or path such as the device disclosed in U.S. 2009/0239686 (Moos) which discloses a baseball bat swing trainer that constrains a baseball bat on a line using a horizontal structure over the head of the batter. The baseball bat swing trainer according to Moos is meant to teach the batter to swing level and prevent a swing below a certain height.

Some other training devices for hitting include a ball suspended from a line that can be hit by the player. In most instances, these types of devices have a ball fixedly attached to the line in a tethered fashion such that the ball stays attached to the line after it is hit. U.S. Pat. No. 3,194,557, for example, discloses a ball practicing device wherein a tethered ball is suspended for contact with a club or bat. Similarly, U.S. Pat. No. 8,033,934 (Clancy) discloses such an apparatus with a baseball connected to a tether (a rope or string). The apparatus according to Clancy can also be adjusted to fold the horizontal member toward the vertical member exposing a ball tee from which the user can hit the ball. The main drawbacks with such tethering devices are 1) safety, the risk that the player will get hit by the ball and/or tether when it swings around or that the player will be injured by the ball if the tether (rope) is struck instead of the ball thereby toppling the device, and 2) the player does not know how proficient their ball contact is because the ball does not travel off of the tether and into the field. Particularly with regard to safety, such tethered devices create the risk that when the ball is struck, the ball and line may begin to spin and swing in an uncontrollable fashion causing the ball and/or line to strike the user or bystanders that may be standing close by or causing the frame to fall. Additionally, the ball and line may become wrapped around the device's frame and/or may become tangled requiring the user to stop practicing and take the time to reconfigure the device before resuming.

Still further attempts to create a better functioning and safer hitting practice device include those with a ball removably secured to the end of a structure or line from which it is suspended. The ball releases from the line when the user strikes the ball with enough force to break the elements holding the ball in place. For example, for particular use for a volleyball, U.S. Pat. No. 6,672,979 (Brenneisen) discloses a device for practicing striking a volleyball held on a pivotable attachment arm assembly using magnetic or magnet-attractable materials. For tennis, U.S. Pat. No. 4,191,372 (Keller) discloses a tennis training device for releasably holding a tennis ball at a height to practice serves and U.S. Pat. No. 7,775,913 (Woods) discloses tennis balls releasably connected to strings depending from a support where the ball releases from the string when the user strikes the ball and the string automatically retracts into the support to reduce interference of the string with the user's subsequent stroke. For baseball, U.S. Pat. No. 3,397,885 (Nash) discloses a ball supporting structure for batting practice with a ball containing a metal screw supported from a linear flexible member (cable or rope) with a ball supporting magnet on the end. While the detachability of the baseball from the supporting magnet helps the hitter see the trajectory of the ball and improves the utility of the device, there still exists the potential danger to the hitter and those around him/her from the swinging linear flexible member with a weighted magnet on the end, particularly if the ball is not hit cleanly or if the ball is missed and the linear flexible member is hit instead. Furthermore, the exposed metal and screws on the ball's surface make the balls dangerous to field and throw.

Another training device for hitting using a tethered ball or releasable ball is disclosed in U.S. Pat. No. 6,790,150 (Moss, et. al.). The device according to Moss et. al. includes a hinged rigid member with the tether and ball attached to the end that swings the ball towards the batter. While the device allows for the ball to release and also includes a detachable feature at the end of the hinged rigid member to prevent the frame from toppling when the batter swings into the tether and tangles the bat, the swinging end of the tether after the ball releases is still a danger to the user and those around him/her. Only if the force is great enough to break the detachable feature, which is designed to prevent toppling of the frame, is the user protected.

There is a need for a hitting practice device that allows a user to practice hitting a baseball with a bat at any ball position that may be encountered by a batter such as when the ball is thrown by a live pitcher, e.g., inches above the plate, six-feet above the plate, inside corner of the plate, outside corner of the plate, off the plate, etc. There is an additional need for a device that can do so in a safe manner. There is an even further need for balls that may be used with such training devices that have an attaching or connecting means concealed below the exterior surface of the ball (e.g., the leather surface) that react substantially similarly to non-modified baseballs when they are thrown, caught, and hit.

Therefore, it is an object of the invention to provide a device that can adjust to provide its user with the full range of ball positions likely to be encountered when hitting during a baseball game. It is also an object of the invention to provide a device that is not a visual obstruction during use resulting in the least amount of distraction to its user while hitting the ball. It is also an object of the invention to provide a device that is safe for its users and for any bystanders by limiting the potential erratic motion of the device and/or its components when in use. Yet another object of the invention is to provide a device that is compact, portable and that can be repeatedly used/operated by a single person. Still another object of the invention is to provide a ball that is releasably connectable to the hitting practice device, but does not pose any additional risk of harm to anyone handling or struck by the ball than would a standard baseball. It is desired to provide a ball that can be safely used with the hitting practice device such that the ball can be safely fielded and played with by others after being hit.

Another object of the invention is to provide a hitting practice device that utilizes a suspended ball that is releasable upon impact and that allows the user to observe the trajectory of the ball thereby allowing the user to see if the ball was hit well. It is furthermore desirable to provide a hitting practice device that utilizes a connector that has the multifunctional ability to (1) releasably connect the second end of a line opposite the ball to a vertical support shaft at varying heights (e.g., a magnet and metallic parts, or a releasable pin, or VELCRO (hook and loop material), etc.), (2) removably connect the second end of a line opposite the ball to a vertical support shaft at varying heights (e.g., with a loop and pegs, or a pin into holes, or buttons, etc.), and (3) connect a counterweight of a predetermined weight to easily suspend the ball at any desired height.

A hitting device that allows for three degrees of freedom of movement of the ball (e.g., in each of the three axes (X, Y, and Z)) prior to hitting the ball is also desired.

SUMMARY OF THE INVENTION

The present invention is a hitting practice device for a releasably suspended ball positionable in numerous positions. The present invention is also the ball having metallic components and/or a magnet inside which can be safely used with or without the device. While the invention will be described in connection with certain embodiments, it will be understood that the invention is not limited to those embodiments. To the contrary, the invention includes all alternatives, modifications and equivalents as may be included within the spirit and scope of the present invention.

The present invention is a novel training device for safely hitting a ball releasably attached to and suspended from a flexible line using a bat. The device is safer than existing devices and it produces better results due to its configuration.

The device is comprised of a weighted base, a vertical support having a bottom and a top with the bottom connected to the base, and a horizontal support connected to the top of the vertical support having a first end and a second end. Preferably, the horizontal support is slidably connected to the vertical support.

The device has a first side and a second side, the first side defined by the side where the first-end magnet and releasable ball are positioned and the second side opposite the first side where the connector is located. The device further includes a flexible line (e.g., rope or wire) having a first end and a second end, said flexible line slidably connected to and supported by the horizontal support such as, for example, a wire inside a hollow tube or pipe wherein the wire can slide within the tube or pipe.

The device further comprises a magnet fixedly connected to said first end of said line, the first-end magnet, and a multifunctional connector fixedly connected to said second end of said line. The connector comprises a magnet, a loop, and a removable counterweight.

The vertical support includes at least one height adjustment peg fixedly attached to said second side of said vertical support where the connector can be releasably connected using the magnet or removably connected using the loop.

The magnet on the connector is configured with a predetermined magnetic strength such that the magnet will detach from the metallic height adjustment peg (if used) when a certain force is imparted on the first side. If the hitter hits the ball cleanly, the connector-magnet will remain in place and the first-end magnet, while it may move or swing a little, will remain in substantially the same location as before the ball was hit suspended at its original position. If the hitter strikes the first-end magnet or the line with a minimum amount of force or if the first-end magnet achieves a minimum amount of kinetic energy, the connector-magnet releases and the first-end magnet safely falls to the ground dissipating the energy in the line. The first-end magnet does not swing dangerously. Consequently, the user knows and learns when the ball was hit correctly by the position of the first-end magnet after impact with the ball—if the connector-magnet releases from the height adjustment peg and the first-end magnet drops then the ball was not hit cleanly.

More experienced hitters that consistently hit the ball cleanly and do not want to use the releasable connector-magnet to avoid the need to reposition the connector can use the connector loop to removably secure the connector to one of the adjustment height pegs at the desired height for the ball.

A height adjustment peg is preferably L-shaped or in a similar shape (e.g., a hook, mushroom) that allows for attachment to the connector-loop. The height adjust peg is also preferably made from or includes a metallic material such that the connector-magnet will magnetically attach to it. Alternatively, the height adjustment pegs can include a magnet(s) and the connector can be made of metallic components without a magnet. Further, both the height adjustment pegs and the connector can include magnets for the magnetic attraction and attachment. As a further alternative, the use of magnetic forces for the releasable connection between the height adjustment pegs and the connector can be accomplished with other structures, such as, for example, VELCRO (hook and loop), pins and holes, snap buttons, etc. Similarly, the removable connection achieved by the loop and peg can be accomplished with locking pins and holes, straps, etc.

A removable counterweight of a predetermined weight is removably attached to the connector. The weight of the counterweight is selected based upon the weight of the releasable ball and/or the desired speed for retraction of the first-end magnet when the ball releases. Different balls can be used with the device of the invention and thus different sized counterweights are included within the scope of the invention. For example, a soft baseball could be used for young children, a regular baseball could be used, a tennis ball could be used, a soccer ball, a softball, etc. With the counterweight secured to the connector and the ball connected to the first-end magnet, the ball can be positioned at any height desirable below the horizontal support by simply grasping the ball, the connector, or the counterweight, and moving it up or down. The counterweight configuration provides easy adjustability. When the ball is hit and releases from the first-end magnet, the counterweight, connector, and the second end of the line always fall on the second side of the device and the first-end magnet always rises up (retracts) to the first end of the horizontal support safely away from the user.

The device further includes a ball having a magnet, or metallic components capable of attaching to a magnet, inside the ball preferably concealed completely below the exterior of the ball, e.g., leather of a baseball, the ball configured to be releasably attachable to the first-end magnet on the first end of the line. The magnet or metallic components are positioned in one or more locations beneath the ball's exterior surface so that the ball remains symmetrical and balanced. In one embodiment, the ball may include a spherical metal object centered within the ball allowing for it to be connected to the first-end magnet at any location on the ball. Alternatively, the ball has a plurality of metallic rods connected at the center of the ball and extending out to the surface of the ball. When the ball includes a magnet, the magnet in the first-end magnet can be removed and replaced with metallic components to achieve the same releasable magnetic connection when the ball is connected.

Using the device with the counterweight on the connector, the ball may be suspended off the ground at any height below the height of the first side of the horizontal support. When the counterweight is removed, the device is still capable of suspending the ball at any height below the height of the first side of the horizontal support using the height adjustment peg(s).

The horizontal support is preferably positioned perpendicular to the vertical support. The horizontal support is preferably configured so as to include a hollowed cavity across its length through which the line passes. In an alternative embodiment, the horizontal support further includes an opening or slot along its underside through which the line passes. In such an embodiment, the horizontal support further includes a T-shaped horizontal slide adjuster through which the line passes to select the distance of the first-end magnet from the vertical support.

The device is further configured to include at least one rotatable (adjustable) joint, a ball bearing joint for example, positioned between the vertical support and the horizontal support. A rotatable (adjustable) joint may alternatively, or additionally, be positioned between the vertical support and the base. The rotatable joint(s) allow the device to be rotated for use by lefty or righty batters and/or to position the ball in different locations along a Z-axis after the base is positioned. The slidable horizontal support and/or the use of the horizontal slide adjuster further provide another degree of freedom for movement for positioning the ball along the X-axis. The height of the suspended ball is adjustable along the Y-axis using the connector and the adjustment pegs and/or the counterweight for a third degree of freedom.

The vertical support and horizontal support are secured to each other by a lockable cross member. The lockable cross member allows the horizontal support to be positioned with respect to the vertical support and allows for the positioning of the horizontal support and consequently the first-end magnet with relation to the vertical support by sliding the horizontal support in the desired direction.

The first end of the line is positioned on the first side of the device hanging vertically due to gravity from the first end of the horizontal support and the second end of the line with the connector is positioned on the second side of the device hanging from the second end of the horizontal support. The first end of the line is comprised of a first-end magnet for releasably securing a ball having metallic components inside it to the line. The second end of the line is comprised of a connector having a second-end magnet, a loop, and a removable counterweight. The connector-magnet is selected (strength of attraction) and configured to releasably secure to any of the height adjustment pegs or alternatively, to a slidable adjustable peg support on the vertical support that moves up and down and is securable at any height on the vertical support.

The adjustable peg support is a ring like structure configured to move up and down along the length of the vertical support and securable at any desired position (height) on the vertical support. The adjustable peg support is preferably made from metallic material. A user may adjust the height of the ball connected to the first-end magnet by moving the adjustable peg support to the desired height and then attaching the connector to the adjustable peg support.

The connector-magnet is configured with a magnetic force that is broken and releases/detaches the connector from the adjustable peg support when a minimum amount of force is imparted on the first end of the line.

In yet another embodiment of the invention, the device includes a telescoping vertical support allowing for the device to be reduced in size so it may be more easily transported and/or to adjust the height of the horizontal support for users of differing heights and ages.

In yet another embodiment of the invention, the device includes a telescoping horizontal support allowing for the horizontal position of the horizontal support to be adjusted between the first side and second side of the device.

In yet another embodiment of the invention, the device includes a horizontal support configured to include an open line slot along its lower surface, and a horizontal slide adjuster that can be adjustably positioned along the length of the horizontal support.

BRIEF DESCRIPTION OF THE DRAWINGS

The accompanying drawings, which are incorporated in and constitute a part of this specification, illustrate embodiments of the invention and, together with the general description of the invention given above and the detailed description of an embodiment given below, serve to explain the principles of the present invention. Similar components of the devices are similarly numbered for simplicity.

FIG. 1 is a rear perspective view of a batter swinging at a ball suspended from one embodiment of the device according to the present invention and hitting the ball squarely at its center. The second end of the line is shown attached to an adjustment peg on the second side of the device using the connector-loop.

FIG. 2 is an enlarged perspective view taken at arrow 2 in FIG. 1 showing a suspended ball on the device in a location relative to a home plate and a bat impacting the ball squarely.

FIG. 8 is a rear perspective view of a batter swinging at a ball suspended from one embodiment of the device according to the present invention and hitting the ball off center. The second end of the line is shown attached to an adjustment peg on the second side of the device using the connector-magnet.

FIG. 9 is an enlarged perspective view of the vertical support taken at arrow 9 in FIG. 8 showing the connector-magnet at the second end of the line releasing from the height adjustment peg when the ball on the first side of the invention is hit off center (FIG. 8). The second end of the line is shown moving upward towards the horizontal support on the second side of the device when the connector-magnet releases from the height adjustment peg, while the first end of the line moves downward on the first side of the device.

FIG. 10 is an enlarged perspective view taken at arrow 10 in FIG. 8 showing a suspended ball on the device in a location relative to home plate and the displacement of the ball from the first-end magnet on the first end of the line when the ball is impacted by a bat off-center. After the ball releases from the first-end magnet, the first-end magnet falls down towards the ground on the first side of the device, while the second end of the line moves upward toward the horizontal support on the second side of the device (FIGS. 8 and 9).

DETAILED DESCRIPTION OF THE INVENTION

Figures 3, 4, 4A, 5:
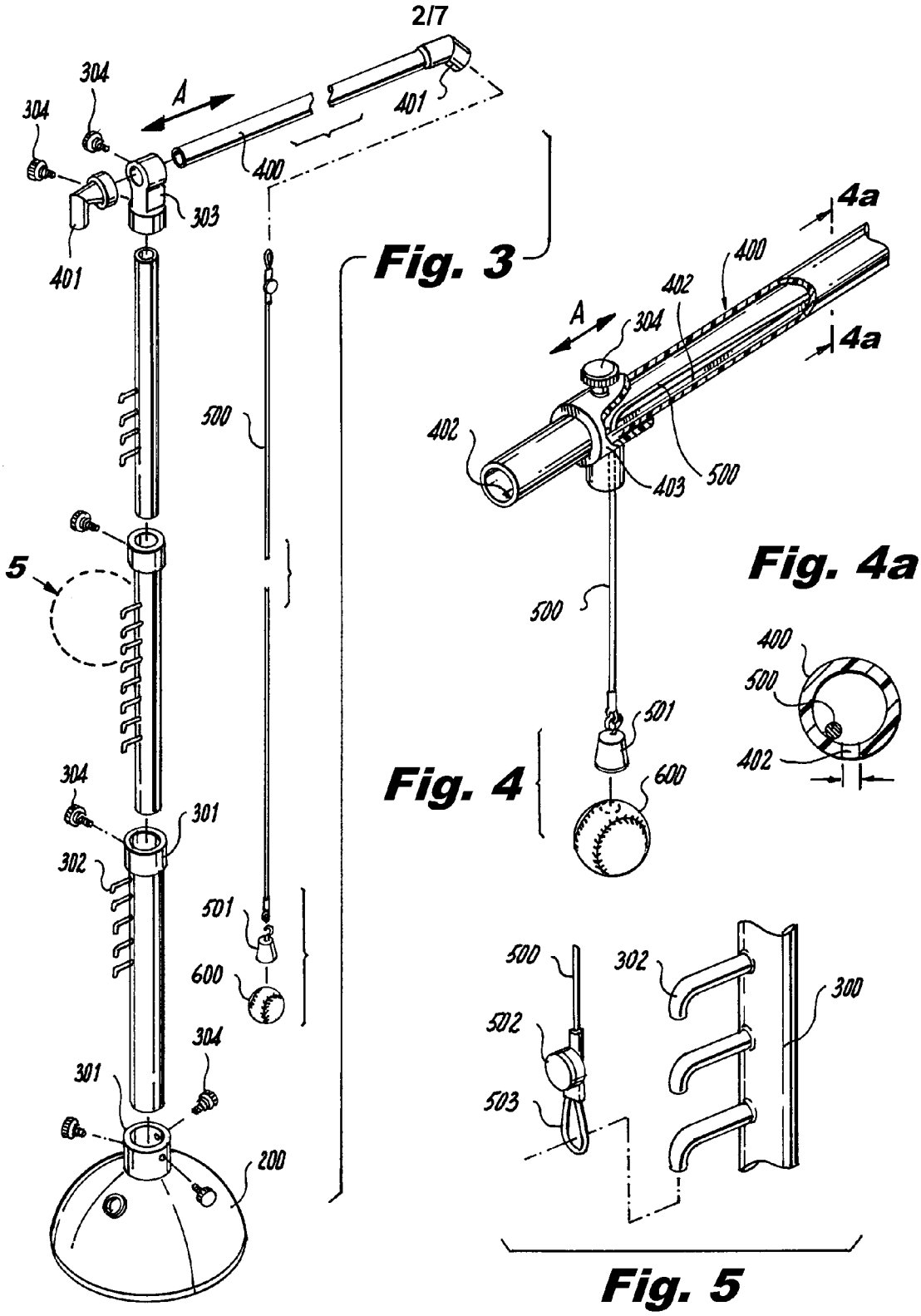
FIG. 3 is a perspective exploded view of the embodiment of the invention shown in FIG. 1 with the line adjacent to the vertical support on the first side of the device.
FIG. 4 is a perspective view of a different embodiment of the device having a horizontal support with a slot and a horizontal slide adjuster.
FIG. 4*a* is a sectional view taken at 4*a*-4*a* on FIG. 4, showing the line running through the hollow center of the horizontal support, and a slot running along the bottom of the horizontal support.
FIG. 5 is an enlarged perspective view of the vertical support taken at arrow 5 in FIG. 3 showing height adjustment pegs and the second end of the line, including the connector-loop and connector-magnet.

In one embodiment of the present invention, the ball hitting practice device and ball is comprised of a weighted base, a vertical support, a horizontal support, a line, and a ball. The device has a first side and a second side. The line is comprised of a first end and a second end. On the first end of the line is a first-end magnet that releasably attaches to the ball. On the second end of the line is a multifunctional connector. The multifunctional connector is comprised of a connector-magnet, a connector-loop and a removable weighted counterweight.

Referring to the Figures, FIGS. 1 through 10 show one embodiment of the invention with different baseball positions and the utility and safety of the device depending upon how the ball is hit. FIGS. 1 and 2 shows a batter practicing hitting a baseball using device 100 comprising a weighted base 200, a vertical support 300, a horizontal support 400, a line 500 and a ball 600.

The weighted base 200 is positioned at the bottom of device 100 on the ground. The weighted base 200 is preferably about dome shaped and functions as a support for the entire device 100, although other base configurations including legs, such as a tripod stand, are included in the scope of the invention. The weighted base 200 shown includes a top and a bottom. In the embodiment shown, the diameter of weighted base 200 at its bottom is preferably larger than the diameter at its top. The weighted base 200 creates stability preventing the device 100 from tipping over. The bottom of weighted base 200 is about flat for placement on the ground or floor.

In the embodiment of the invention shown in the Figures, weighted base 200 is hollow having an inner cavity including a removable and sealable cap 201 which provides access to said inner cavity. The cap 201 may be secured to weighted base 200 by threading into the base 200 at the point of entry to the inner cavity. Cap 201 may also be secured to weighted base 200 by way of friction fitting the two together and/or by any other means capable of maintaining cap 201 securely, yet removably, in position to prevent the contents of the base 200 (e.g., sand, water, etc.) from undesirably entering into or exiting out of the base's inner cavity. The cap 201 may be removed to allow a user to fill or empty the weighted base inner cavity with materials such as, for example sand or water to add more weight and therefore greater stability to weighted base 200 when so desired and to also allow those materials to be removed so as to reduce the overall weight of the base 200 when the base 200 is transported. In other embodiments of the invention, the weighted base 200 may be solid and weighted and may not include cap 201.

The weighted base 200 may additionally include a locking ring 301 used to removably secure vertical support 300 to weighted base 200. Preferably, the locking ring 301 includes at least one locking screw 304 to removably secure the vertical support 300 to weighted base 200. In the embodiment shown in FIG. 1, locking ring 301 includes three locking screws 304. When the at least one locking screw 304 is not fully tightened against the vertical support, a user may rotate vertical support 300 as much as 360 degrees in direction C (i.e., about the longitudinal axis of the vertical support) on weighted base 200. This rotation provides for the device's first degree of freedom for positioning the ball allowing for movement in the Z-axis. When the desired rotational positioning/orientation of vertical support 300 is reached, the user can secure the vertical support in place by tighten locking screw(s) 304 thereby preventing vertical support 300 from rotating further.

It is understood that applicants' invention includes vertical supports with smooth exterior surfaces for connection to the locking screw(s) 304 such as, for example, the exterior of a pipe. Alternatively, the portion of the vertical support 300 connecting to the base 200 may be configured to more securely connect to the locking screw(s) 304 such as, for example, using threads, apertures, etc., that receive the end of the locking screw(s) 304.

In yet another embodiment of the invention, the end of the vertical support 300 may be threaded and screwed into the locking ring 301 which is configured with internal threads that are complementary to the threads on the bottom end of vertical support 300. Still another alternative is to include on locking ring 301*a* quick-release locking collar allowing for one-handed adjustment, locking and unlocking.

In still another embodiment of the invention, the locking ring 301 may include a ball bearing(s) further facilitating rotation of vertical support 300 in the weighted base 200 in direction C.

It is understood that weighted base 200 may be formed in a variety of shapes other than circular including, but not limited to, square, rectangular, oval, etc. Weighted base 200 may be made from a variety of materials including, but not limited to, metal, plastic or a combination thereof. The weighted base 200 is preferably made from a material(s) that is rigid, impact resistant, light weight and corrosive resistant.

The bottom of weighted base 200 may include an added layer of material to help prevent movement (e.g. slippage) of the device 100 once put into positions such as, for example, a rubber material. The rubber layer can be applied to the bottom of the base using an adhesive or fasteners (screws, bolts, etc.). The rubber layer would additionally dissipate some of the force and vibration that is indirectly transferred to weighted base 200 when device 100 is used.

The weighted base 200 may additionally include a padded exterior for added safety in the event someone (e.g. a user or bystander) was to accidently come into contact with the weighted base.

In other embodiments, weighted base 200 may also include wheels and handles for portability. The inclusion of wheels allows a single user to transport, set up and operate device 100. The wheels may be lockable or removable for when device 100 is in use.

In yet another embodiment of the invention the weighted base 200 may be configured without the base so as to be permanently installable in the ground and/or made to be secured directly to the ground or the playing surface (e.g. a gym floor). It is understood that even in this embodiment, the vertical support 300 would still preferably be capable of rotating 360 degrees in direction C.

As shown in the embodiment in FIG. 1, vertical support 300 of device 100 includes three sections, it being understood that the vertical support 300 can be comprised of any number of sections including as few as one. Vertical support 300 has a top end, a bottom end, a first side and a second side. The first and second sides of vertical support 300 correspond to the first and second sides of device 100. The bottom end of vertical support 300 secures to weighted base 200.

The vertical support 300 shown in FIG. 1 is telescoping. The vertical support 300 is comprised of three cylindrical hollow sections of graduated diameter being wider towards the bottom end of the vertical support 300 than at the top end of the vertical support 300. The telescoping sections of vertical support 300, when collapsed, fit within one of the sections allowing for the device to become more compact and easier to transport.

In the embodiment shown in FIG. 1, vertical support 300, at the connections between its sections, include locking rings 301 that can be engaged to selectively lock the sections of vertical support 300 in the open/extended, closed/collapsed or intermediate positions. As previously discussed above, locking rings 301 allow for the individual sections of vertical support 300 to be rotated up to 360 degrees with respect to each other and with respect to weighted base 200 in direction C (See FIG. 16). The inclusion of one or more locking rings along the length of vertical support 300 further contributes to device 100's first degree of freedom for movement in direction B along the Y-axis.

Although vertical support 300 is shown as being cylindrical in shape, it is understood that the shape of the vertical support 300 is not limited to cylindrical. The cross-sectional shape of vertical support 300 may be made of a variety of other shapes or configurations including but not limited to square, oval and rectangular. It is preferred that vertical support 300 is configured in a shape that promotes strength, rigidity and utility.

For added adjustability, vertical support 300, at one or more of the connections between sections may include a rotatable joint(s) similar to the one described on weighted base 200.

In other embodiments of the invention, vertical support 300 may be comprised of fewer or more than three telescoping sections. In other embodiments of the invention such as that shown in FIG. 16, vertical support 300 can also have a unitary structure constructed from a single piece of material, not telescoping.

The vertical support 300 may additionally be solid rather than hollow, although it is preferred that it be hollow to reduce device 100's overall weight and ease of portability.

The vertical support 300 further includes at least one height adjustment peg 302 attached to its second side upon which the second end of line 500 can be releasably or removably connected to vertical support 300 using either the connector-magnet 502 or the connector-loop 503, respectively. The height adjustment peg(s) 302 is preferably L-shaped (e.g., like a hook), allowing for removable attachment of connector-loop 503 to height adjustment peg(s) 302 as depicted in FIG. 5. The height adjustment peg(s) 302 may also be made in other shapes/configurations, including, for example, mushroom or peg shaped as shown in FIG. 9, or any other configuration that allows for the removable attachment of connector-loop 503 to height adjustment peg(s) 302 as well as the releasable attachment of the connector-magnet.

Figure 15:
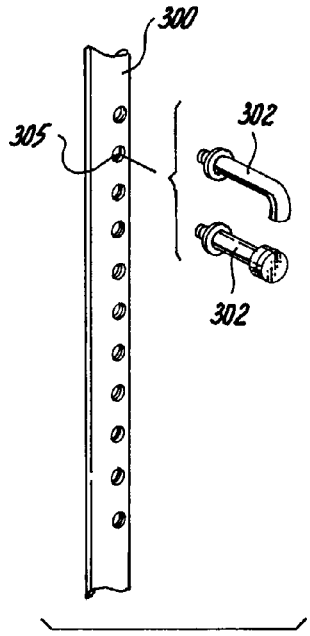
FIG. 15 is an enlarged perspective view of the second side of the vertical support in an alternative embodiment of the device having removable adjustable pegs that connect to peg apertures on the vertical support. Pegs having two different configurations are shown.

In one embodiment of the invention, height adjustment peg(s) 302 may be fixedly attached on vertical support 300. In another embodiment, height adjustment pegs may be removable so that it/they may be selectively secured at different heights along vertical support 300 by inserting the height adjustment peg(s) 302 into peg aperture(s) 305 as shown in FIG. 15. A removable adjustment peg(s) 302 may thread into the peg apertures and/or they may be held in position by friction or by any other removable locking means such as, for example, a tapered pin.

Figure 16:
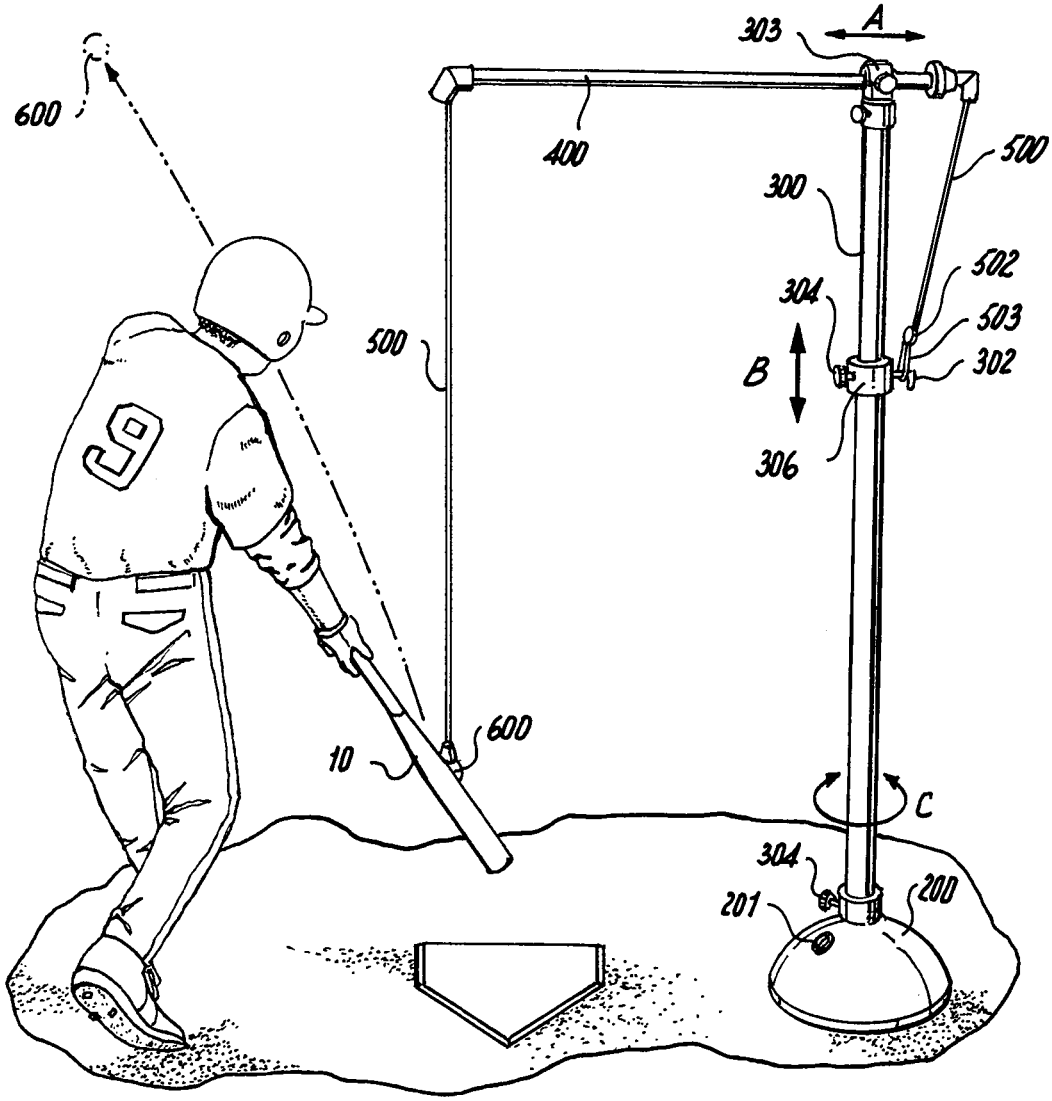
FIG. 16 is a rear perspective view of a batter swinging at a ball suspended from an alternative embodiment of the device hitting the ball at its center. The vertical support has a slidable adjustment peg for connection to the connector.

In yet another embodiment of the invention shown in FIG. 16, vertical support 300 may include one or more sliding peg supports 306. A sliding peg support 306 is a ring like structure that includes one or more adjustment pegs 302 configured to slide directly over vertical support 300 up and down along the length of vertical support 300 in direction B (along the Y-axis). The sliding peg support 306 is securable at the desired height using one or more locking screws 304. The sliding peg support 306 may also be made without locking screw 304, but instead may rely on friction between its inner surface and the outer surface of vertical support 300 to keep it in a desired position. It is preferred that sliding peg support 306 be used with a vertical support having a unibody structure rather than being segmented with sections so that sliding peg support 306 may be positioned along any position of vertical support 300 by sliding it along the entire length (height) of vertical support 300 such as shown in FIG. 16. In yet another embodiment of the invention, the vertical support 300 could have fixedly attached to it a fastening device for the line 500, such as, for example, a spring-loaded clamp or clasp, allowing the user to fix line 500 at the desired height by positioning the line 500 in the clamp/clasp.

In embodiments having a vertical support 300 that is segmented and/or telescoping (two or more sections), each section of the vertical support may include its own sliding peg support 306.

In still other embodiments of the invention, the internal diameter of sliding peg support 306 (where vertical support 300 passes through the sliding peg support) may be adjustable, so as to accommodate vertical supports or sections thereof, having different diameters.

The sliding peg support 306, and its height adjustment peg(s) 302 are preferably made from a magnetically attractable metal, allowing connector-magnet 502 to releasably attach to the sliding peg support 306 and also allowing for connector-loop 503 to removably connect to height adjustment peg(s) 302.

Figure 14:
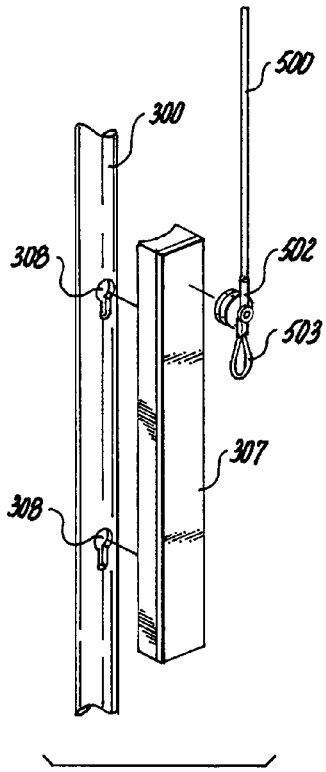
FIG. 14 is an enlarged perspective view of the second side of the vertical support in an alternative embodiment of the device having a removable metallic plate that attaches to plate apertures on the vertical support. The connector-magnet on the second end of the line is shown releasably connectable to the metallic plate.

In yet another embodiment of the invention, as shown in FIG. 14, vertical support 300 may be made without adjustment pegs, but may instead include one or more removable metallic plate(s) 307 that can be removably secured to vertical support 300 by securing connector pegs (not shown) on the back of removable metallic plate 307 into complementarily shaped plate apertures 308 positioned along different heights of vertical support 300. Removable metallic plate 307 provides an about flat metallic surface onto which connector-magnet 502 of line 500 may be releasably connected, allowing for even greater adjustability of device 100 because it does not include fixed, predetermined points of attachment. Instead, removable metallic plate 307 allows a user to secure the second end of line 500 to any point along the front surface of the removable metallic plate 307 using connector-magnet 502 and to slide connector-magnet 502 along the entire length of removable metallic plate 307. The length of removable metallic plate 307 may be varied based on the degree of vertical adjustment that is required. Removable metallic plate 307 is preferably made from a metallic material capable of attaching to a magnet. Removable metallic plate 307 also may itself be made from a material having magnetic properties.

The configurations of device 100, including the height adjustment peg(s) 302, sliding peg support 306 and/or removable metallic plate 307, allow for a user to connect the connector 505 on the second end of line 500 to various points along the height of vertical support 300 when using device 100. This resulting adjustability of the device and thus the height of the ball in direction B along the Y-axis comprises the second degree of freedom for positioning the ball. The height of ball 600 connected to the first-end magnet on line 500 can be adjusted to a variety of heights on the first side of the device. For example, securing the connector 505 at a point along vertical support 300 closer to base 200 results in the height of ball 600 on the first side of device 100 being higher and closer to horizontal support 400. Likewise, securing the connector 505 at a point along vertical support 300 higher and farther away from base 200 results in the height of ball 600 on the first side of device 100 being lower and closer to the ground (as shown in FIG. 16). It is preferred that the height of ball 600 be adjustable from at least anywhere between 0 to 8 feet above the ground on which the device rests. It is understood that this height may vary depending on the height of base 200, vertical support 300 and on the length of line 500.

The vertical support 300 and its components may be made from a variety of natural or synthetic materials or a combination thereof including but not limited to metal and/or plastics. It is preferable that the vertical support 300 be made from a material that is rigid, impact resistant, light weight and resistant to corrosion. The vertical support may additionally include a padded exterior padding for added safety in the event someone were to accidently contact the vertical support. It is understood that any padding secured to vertical support 300 would preferably be so configured so as to not interfere with the adjustability of vertical support 300 discussed above.

At the top end of vertical support 300 is lockable cross member 303. The lockable cross member 303 is a "T" shaped structure that connects vertical support 300 to horizontal support 400. The lockable cross member 303 has a base that removably connects to the top end of vertical support 300. The lockable cross member 303 may be connected to the top end of vertical support 300 by a variety of means, including but not limited to threading the two together or by using a removable bolt/screw. In other embodiments of the invention, lockable cross member 303 may be permanently secured to (e.g. welded, glued), or be made as one piece with the top end of vertical support 300. About perpendicular to and directly above its base, cross member 303 includes an aperture through which horizontal support 400 passes. The cross member aperture is configured to removably and slidably receive and support horizontal support 400. The dimensions of the cross member aperture are complementary to and slightly larger than the external dimensions/diameter of horizontal support 400 so that horizontal support 400 slides within cross member 303 in direction A along the X-axis, either more towards the first or second side of device 100. The ability to slide horizontal support 400 towards the first or second side of device 100 is the third degree of freedom for the positioning of the ball enabled by the device. The vertical cross member 303 includes one or more locking screws 304 to help selectively secure horizontal support 400 in the desired position within the vertical cross member aperture. In other embodiments of the invention, vertical cross member 303 may be made so as not to include a locking screw(s) 304.

Device 100 further comprises horizontal support 400 having a first side and a second side. Preferably, horizontal support 400 is about cylindrical in shape and is configured so as to include an internal aperture/cavity its entire length through which line 500 can pass. Although horizontal support 400 is shown as being cylindrical in shape, it is understood that the shape of horizontal support 400 is not limited to that of a cylinder. Instead, the cross sectional configuration of horizontal support 400 may be made in a variety of other shapes or configurations including but not limited to square, oval and rectangular. It is preferred that horizontal support 400 is configured in a shape that promotes its structural rigidity and strength.

The length of horizontal support 400 may vary depending upon the degree of horizontal adjustability for movement of the ball in direction A that is desired.

In other embodiments of the invention, horizontal support 400, rather than being constructed as a single piece may be telescoping, allowing for the adjustment of its length, in addition to the position(s) of the ends of the horizontal support 400 on the first side and/or the second side of device 100.

The horizontal support 400, at its two ends includes line guides 401 that help guide/direct line 500 in a downward direction. It is understood that other embodiments of the invention include one or more pulleys positioned within horizontal support 400, and/or on the line guides 401 to assist with movement of the line in relation to the horizontal support 400. The horizontal support 400 is secured to the top end of vertical support 300 by way of lockable cross member 303 described above, so that the first side of horizontal support 400 is on the first side of device 100, and so that the second side of horizontal support 400 is on the second side of device 100. Lockable cross member 303 allows horizontal support 400 to be positioned along the X-axis with respect to vertical support 300, allowing for the position of the first end of the horizontal support 400 on the first side of device 100.

FIGS. 4 and 4*a* show an alternative embodiment for horizontal support 400 including horizontal slide adjuster 403 and a line slot 402 along its underside through which line 500 may pass and slide. Horizontal slide adjuster 403 is slidably mounted on the outer (or inner) surface of horizontal support 400 on the first side of the device. Line slot 402 may extend the entire length of horizontal support 400 or only a portion thereof, preferably on the first side of horizontal support 400 but it could be included on both sides of the horizontal support 400.

The width of line slot 402 is preferably greater than the diameter of line 500 so that line 500 may easily slide through the slot 402 without binding. The horizontal line adjuster 403 may be positioned on horizontal support 400 and moved in direction A along axis X to select the desired distance that line 500 and ball 600 are suspended away from vertical support 300, e.g., the position of the ball relative to home plate. As horizontal line adjuster 403 is positioned closer to the vertical support 300, line 500 and any ball connected to the first-end magnet is positioned further away from the batter standing on the device's first side with the batter standing with respect to the device 100 as shown in FIG. 1. Likewise, as horizontal line adjuster 403 is positioned further away from vertical support 300, line 500 and the ball attached to its first-end magnet is positioned closer to the batter standing on the device's first side with the batter standing with respect to the device 100 as shown in FIG. 1.

Horizontal line adjuster 403 preferably additionally includes one or more locking screws 304 to help further selectively secure horizontal line adjuster 403 in the desired position along horizontal support 400. In other embodiments, horizontal line adjuster 403 may be made so as not to include a locking screw(s) 304.

In one embodiment of the invention, as shown in FIG. 1, the device further includes support brackets 390 between the vertical support 300 and the horizontal support 400. Support bracket 390 helps support the weight of the horizontal support 300 and provide rigidity to the device. The embodiment shown in FIG. 1 shows two support brackets 390 it being understood that the device could be made with one support bracket 390 or without any support bracket as shown, for example, in FIGS. 8 and 16.

Horizontal support 400 and its components, including horizontal line adjuster 403, may be made from a variety of natural or synthetic materials or a combination thereof including but not limited to metal and/or plastic. It is preferable that horizontal support 400 be made from materials that are rigid, impact resistant, light weight and resistant to corrosion.

Device 100 is further comprised of line 500. Line 500 includes a first end and a second end. Line 500 is positioned inside horizontal support 400 so that the first end of line 500 is positioned on the first side of the device hanging vertically under the first end of horizontal support 400 and the second end of line 500 with connector 505 is positioned under the second end of the horizontal support 400 on the second side of device 100. Line 500 may be made from a variety of natural or synthetic materials or a combination thereof including but not limited to rope, steel cable, parachord, etc. The length and thickness of line 500 may also be varied according to the size of horizontal support 400 and vertical support 300, the weight of ball 600 and/or according to preference. Line 500 is most preferably constructed from 1/16" laminated wire. Additionally, the width and color of line 500 is most preferably configured so as to be as less obtrusive and distractive to the user when using device 100. Other line sizes, including, e.g., 1/32-inch, are within the scope of the invention.

At its first end, line 500 includes a first-end magnet 501 which releasably connects to ball 600. The strength of first-end magnet 501 may be varied so as to require a greater or lesser striking force to be exerted on the first end of line 500 and/or ball 600 suspended therefrom to release first-end magnet 501 from ball 600 or to suspend a heavier or lighter ball. At its second end, line 500 includes a multifunctional connector 505. Connector 505 is comprised of a connector-magnet 502, a connector-loop 503 and a removable counterweight 504. The strength of the connector-magnet 502 may be varied so as to release from the corresponding connection points on the components on the vertical support 300 upon a greater or lesser force.

First-end magnet 501 is preferably a small and lightweight magnet that releases the ball 600 when a minimum amount of force is exerted on the ball. It is desired to have the least magnetic attraction needed to hold the ball 600 such that the ball will freely release without affecting the trajectory of the ball 600. Preferably to avoid damage to the bat 10 when striking the ball 600 and/or the first-end magnet 501, the first-end magnet 501 is a magnet surrounded by an enclosure. A soft enclosure is preferred to reduce the energy imparted into the first end of the line when the first-end magnet 501 is hit. In the embodiment shown in the Figures, the first-end magnet 501 is encased within a soft rubber enclosure with the magnet exposed at the bottom of the enclosure flush with the bottom to prevent contact between the magnet and the bat. It is understood that the invention includes embodiments with the magnet fully and completely concealed in the enclosure as well as embodiments with the magnet countersunk beneath the surface of the enclosure. It is also desirable to keep the first-end magnet as small as possible to minimize visual distractions to the batter.

Connector 505 is comprised of a connector-magnet 502, a connector-loop 503 and a removable counterweight 504. Connector 505 is configured so that it either releasably connects to the vertical support 300, removably connects to the vertical support 300, or freely hangs on the second side of the device unconnected to the vertical support 300. The connector releasably connects using connector-magnet 502, removably connects using connector-loop 503, and freely hangs when counterweight 504 is used.

Preferably, connector-magnet 502 is a small and lightweight magnet that is easily connectable to the vertical support 300. The strength of the connector-magnet 502 can be varied depending upon how strong a force the user wants the device to withstand before the magnet releases. Accordingly, the connector-magnet in the device can be removed and replaced with a different strength magnet, e.g., a variable connector-magnet. The connector-end magnet 502 could be an exposed magnet and/or enclosed with a protective enclosure such as soft rubber.

Connector-loop 503 is a loop that is removably connectable on a height adjustment peg 302 by sliding the aperture or hole in the loop over the end of a height adjustment peg 302. The configuration and shape of the height adjustment peg 302 helps to maintain the connector-loop 503 on the selected height adjustment peg 302.

Figure 11:
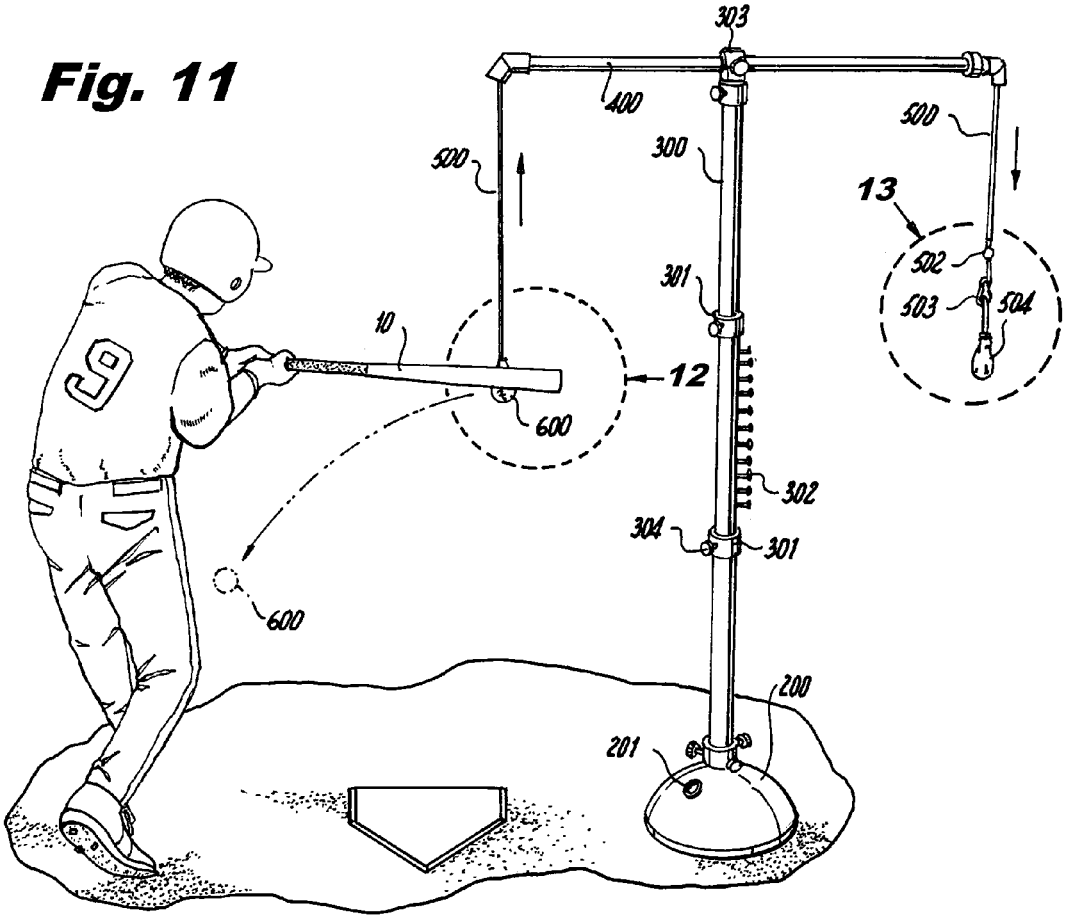
FIG. 11 is a rear perspective view of a batter swinging at a ball suspended from one embodiment of the device according to the present invention and hitting the ball off center. The second end of the line has the counterweight on the connector.
Figure 13:
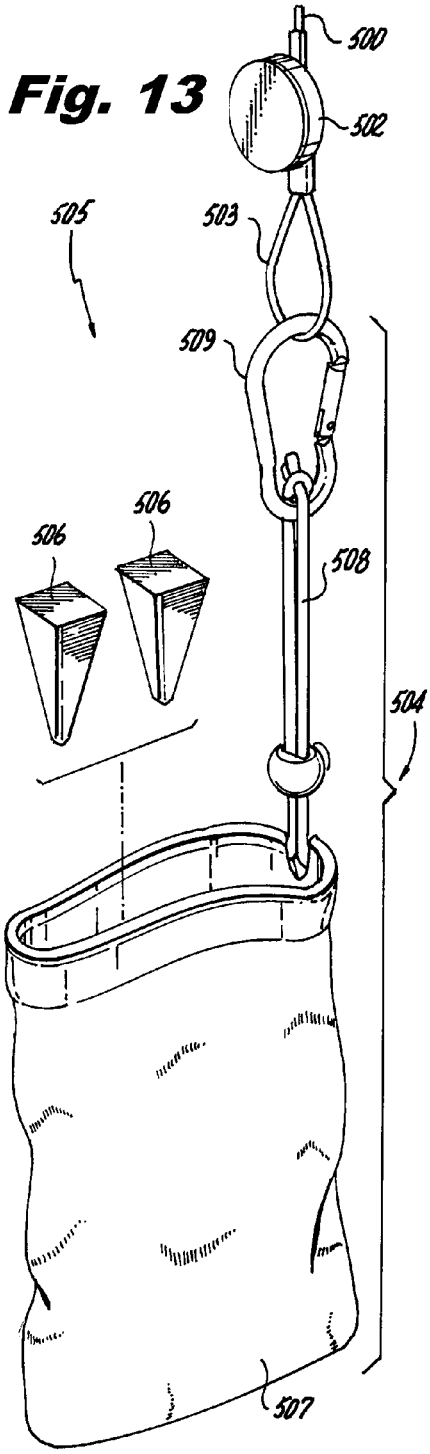
FIG. 13 is an enlarged perspective view of the multifunctional connector taken at arrow 13 in FIG. 11 showing the second end of the line, the connector-magnet, the connector-loop, the counterweight bag and weights.

Counterweight 504 is preferably comprised of a bag 507 having a drawstring 508 and a counterweight latch 509. Counterweight bag 507 can be selectively filled with weights 506 until the desired weight is reached that maintains the ball 600 suspended in the air on the first side of the device. Counterweight bag 507 can be closed using drawstring 508 and removably secured to connecter-loop 503 using counterweight latch 509. In embodiment shown in FIG. 13, counterweight latch 509 is a karabiner, although it is understood that a variety of other latches may also be used to removably secure counterweight 504 to connecter-loop 503. The weight of counterweight 504 is selected to be about equal to the weight of ball 600 and first-end magnet 501 on first end of line 500 such that the ball 600 remains suspended and can be adjusted to the height selected by the batter without securing the second end of line 500 to vertical support 300 as shown in FIG. 11. The removal of the ball 600 from the first end on line 500 causes the counterweight 504 to fall towards the base (e.g., the ground) on the second side of device 100. Other embodiments of the invention include a counterweight 504 with a container or other weight holding apparatus in place of a bag capable of being filled with weights 506 (e.g. a can, tube, etc). Still further embodiments of the invention include counterweights directly connectable to the loop 503 without any bag or container.

Figure 6:
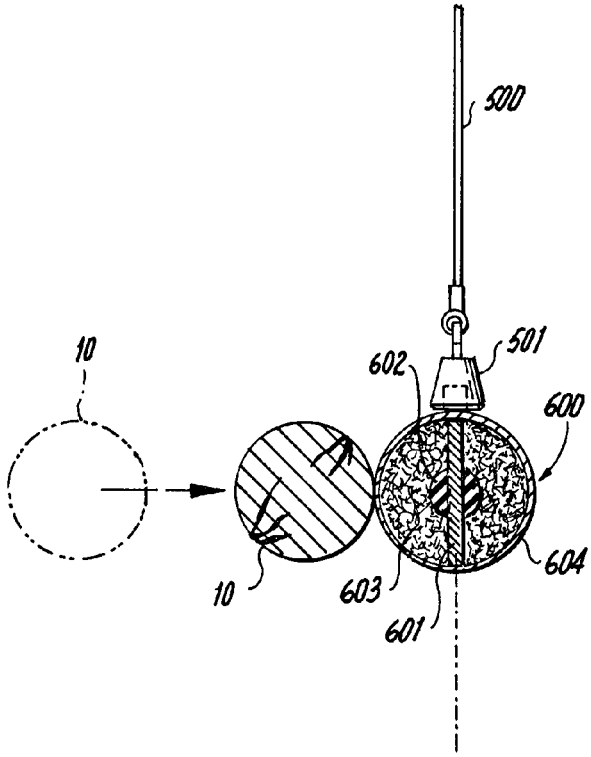
FIG. 6 is a diagrammatic sectional view taken at 6-6 on FIG. 2, showing the resistance welded rod running through the center of the ball and contacting the first-end magnet on the first end of the line and further showing a bat impacting the ball.

Applicants' invention further includes the ball. As shown in FIG. 6, a cross-sectional view of ball 600 and bat 10, ball 600 is comprised of a metal rod 601 passing through the ball's diameter. For a baseball, ball 600, like a conventional baseball, is further comprised of a rubber or cork center 602, wrapped in yarn 603, and covered in leather 604. Most preferably, metal rod 601 is fully concealed inside the ball 600 beneath the exterior leather surface of ball 600. Metal rod 601 may be a single piece of metal or it may be further comprised of two or more pieces of metal that are resistance welded together within the ball, preferably at about the center of ball 600. Metal rod 601 is preferably made from a metal capable of magnetic attraction and connectivity. First-end magnet 501 removably connects to ball 600 at either one of the two opposing ends of metal rod 601 below the ball's leather surface 604.

Other embodiments of the invention include a ball 600 with a plurality of metal rods 601 in the ball connected at its center.

In yet another embodiment of the invention, ball 600 may include a metal sphere beneath its outer surface that allows first-end magnet 501 to secure to any point along ball 600's outer surface rather than spot locations on the ball. When ball 600 is configured to include the magnet, the first-end magnet can be configured with metallic components instead of a magnet.

The device according to the invention is capable of being used in at least three different ways depending on the use of the connector selected, the level of skill of the batter, and/or the desired safety tolerance. A user may use the device with the connector looped onto the second side of the vertical support, magnetically and releasably connected to the second side of the vertical support, or unconnected to the second side of the vertical support using the counterweight. Accordingly, the user can have the first-end magnet remain at the selected height after the ball is hit irrespective of whether or not the ball is hit cleanly, the user can select to have the first-end magnet drop to the ground when the ball is not hit cleanly, or the user can select to have the first-end magnet rise up irrespective of whether or not the ball is hit cleanly, respectively.

For purposes of explaining how device 100 is used, the device will be described with respect to hitting a baseball. It is understood that device 100 may be used with other types of balls, including but not limited to softballs, tennis balls, etc.

The user attaches ball 600 to first end magnet 501 by aligning one of the two ends of metal rod 601 in ball 600 with first-end magnet 501 and touching them together. The position of ball 600 on the first side of device 100 is then set (e.g. closer to the user, farther from the user, height, front/back, etc.) by 1) rotating vertical support 300 about the axis of the vertical support in direction C resulting in movement in the Z-axis, 2) sliding horizontal support 400 in either direction A resulting in movement in X-axis, and/or 3) moving the ball or counterweight up or down in direction B resulting in movement in the Y axis by adjusting the height of the counterweight (if used) or by connecting the connector 505 to the vertical support using the connector-loop 503 or the connector-magnet 502. Device 100, through its multitude of available adjustments, provides three degrees of freedom for positioning the ball to practice the full range of ball positions likely to be encountered when hitting a ball during a baseball game. Once the desired position of suspended ball 600 is set, the user tightens the locking screw(s) 304, if present, to secure the horizontal support 400 and vertical support 300 in place. The user can then hit the ball.

Figure 7:
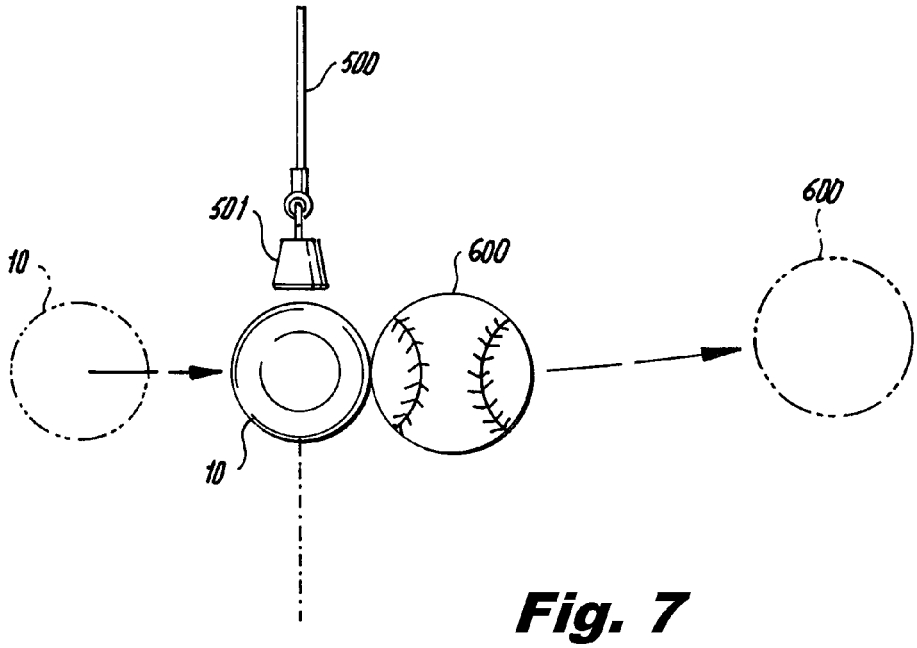
FIG. 7 is a view of the device shown in FIG. 6 showing a suspended ball on the device in a location relative to home plate and the displacement of the ball away from the first-end magnet on the first end of the line after the ball is impacted by a bat. After the ball releases from the first-end magnet on the line, the line remains in substantially the same location.

When using connector-loop 503 to connect the connector 505 to the vertical support 300 using, e.g., an adjustable peg 302 on the second side of vertical support 300, the connector 505 and second end of the line 500 will remain secured to the selected adjustable peg when the user strikes ball 600 with bat 10 regardless of whether ball 600 is mishit (off center) or hit properly at its center. Connector-loop 503 remains attached to the selected adjustable peg 302 resulting in the height of first end magnet 501 remaining unchanged after it comes to rest. If ball 600 is hit cleanly (squarely), the first end of line 500 and first-end magnet will remain in about the same location due in large part to the fact that the diameter of the barrel of a baseball bat is slightly smaller than the diameter of a baseball as depicted by FIGS. 6 and 7. If ball 600 is not hit cleanly (e.g., it is mishit or hit off-center), the first end of line 500 and first-end magnet 501 may swing and/or rotate. The user can see the trajectory of the ball 600 and evaluate the practice swing. The user may continue practicing hitting from the same ball position by attaching another ball 600 to first-end magnet 501. Alternatively, the user can adjust the position of the next ball before hitting it in any of the three axes. Use of the connector-loop 503 is preferred for users with a higher level of skill capable of consistently hitting the ball properly and/or for users with a lower level of safety concern. The first-end magnet will swing around more the less cleanly the ball is hit. This configuration also allows for faster placement of the next ball 601 for hitting.

When using the connector-magnet 502 to attach connector 505 to the vertical support 300 on an adjustable peg 302, the connector 505 will remain connected to the selected adjustable peg when the user strikes ball 600 with bat 10 unless a minimum amount of energy is imparted into the line 500 causing the connector-magnet 502 to release away from the adjustment peg 302. If the user strikes the first-end magnet 501 or the line 500 hard enough or if the user causes the first-end magnet 501 to swing hard enough, then the connector-magnet 502 will release and the first-end magnet 501 will fall down safely to the ground as shown in FIGS. 8 through 10. If ball 600 is hit cleanly (squarely) and a smaller amount of energy needed to release the connection or no energy is imparted into the first-end magnet 501, the first-end magnet 501 will remain in about the same location and it will not fall. This is indicative of a clean hit. The user can also see the trajectory of the ball to evaluate the practice swing. The user may continue practicing hitting from the same ball position by attaching another ball 600 to first-end magnet 501. Alternatively, the user can adjust the position of the next ball before hitting it. This method of use is safer and preferred for users who have a lesser degree of skill. The releasability of the connector-magnet 502 decreases the kinetic energy of line 500 and first-end magnet 501 and lessens the probability of it swinging into the user for safety.

Figure 12:
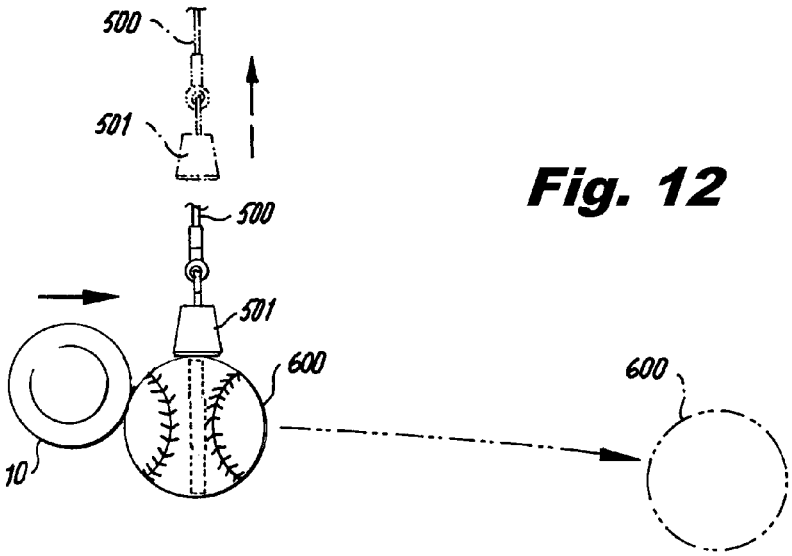
FIG. 12 is an enlarged perspective view taken at arrow 12 in FIG. 11 showing the movement of the first-end magnet up when the ball is impacted off-center.

When using the counterweight 504 and not connecting the connector 505 to the vertical support 300, with the proper counterweight, the ball 600 will remain suspended at any height selected by the user. When the user strikes ball 600 with bat 10 with enough force to release ball 600 from the first-end magnet 501, the counterweight 504 will fall pulling first-end magnet 501 up safely whether or not the ball 600 is hit cleanly (squarely) as shown in FIGS. 11 and 12. The user can see the trajectory of the ball to evaluate the practice swing. The user may continue practicing hitting from the same ball position by attaching another ball 600 to first end magnet 501 and positing the height of the ball. Alternatively, the user can adjust the position of the next ball before hitting it. This method of use always results in a rising of the first-end magnet 501 up out of the way and is preferred for users with the least degree of level of skill and/or for users seeking more safety.

The connector 505 on second end of line 500 is configured larger than the cavity of horizontal support 400 so that it does not retract into the horizontal support 400. Alternatively, accessories, such as for example, objects larger than the opening in the end of the horizontal support (a pin or ball) can be fixedly attached to the line 500 on the first side of the device above first-end magnet 501.

We claim:

1. A ball hitting practice device comprising a weighted base, a vertical support connected to the base, and a horizontal support slidably connected to a top of the vertical support, said device having a first side and a second side at two ends of the horizontal support;

a line having a first end and a second end, said line slidably connected to the horizontal support;

a first-end magnet fixedly connected to said first end of said line;

a connector fixedly connected to said second end of said line comprising a connector-magnet, a connector-loop, and a removable counterweight;

at least one height adjustment peg attached to said vertical support on said second side of said vertical support;

wherein a ball having a magnetic component concealed beneath said ball's outside surface is releasably attachable to said first-end magnet; and wherein said ball is suspended off the ground at any height below a height of the first side of said horizontal support when said removable counterweight is attached to said connector.

2. The device according to claim 1, wherein said first end of said line and said first-end magnet rises toward the first side of said horizontal support when said ball is released from said first-end magnet.

3. The device according to claim 1, comprising at least one magnetic height adjustment pegs fixedly attached to said second side of said vertical support.

4. The device according to claim 3, wherein the height of said at least one height adjustment peg is slidably adjustable on said vertical support.

5. The device according to claim 1, wherein said vertical support is rotatably connected to said base.

6. The device according to claim 1, wherein said vertical support is telescoping and collapsable for portability.

7. The device according to claim 1, wherein said vertical support comprises a lockable cross member at the top of said vertical support; wherein said horizontal support is slidably connected to said lockable cross member.

8. The device according to claim 1, wherein when said removable counterweight is removed, said ball is suspended off the ground at a predetermined height by releasably connecting said connector-magnet on said second end of said line to a height adjustment peg.

9. The device according to claim 8, wherein said first end of said line and said first-end magnet drops towards said base on said first side of said vertical support when said ball is released from said first-end magnet and said connector-magnet is released from said at least one height adjustment peg.

10. The device according to claim 1, wherein when said removable counterweight is removed, said ball is suspended off the ground at a predetermined height by removably connecting said connector-loop on said second end of said line with a height adjustment peg.

11. The device according to claim 1, wherein said ball comprises a metal rod through the diameter of said ball fully concealed beneath said ball's exterior surface of the ball.

12. The device according to claim 11, wherein said metal rod is comprised of two pieces of metal resistance welded together.

13. A ball hitting practice device comprising a vertical support and a horizontal support connected to a top of the vertical support, said device having a first side and a second side;

a flexible line having a first end and a second end, said line received slidably inside the horizontal support;

a first-end magnet fixedly connected to said first end of said flexible line;

a connector fixedly connected to said second end of said flexible line comprising a connector-magnet, a connector-loop, and a removable counterweight;

at least one height adjustment peg attached to said vertical support on said second side of said vertical support;

wherein a ball having a metallic rod inside is releasably attachable to said first-end magnet;

wherein said ball is suspended off the ground at any height below a height of the first side of said horizontal support when said counterweight is removably connected to said connector; and wherein a user can select whether the first-end magnet will rise or fall when the ball is struck and the first-end magnet swings a predetermined amount by using either the removable counterweight or the connector-magnet to attach said connector to said at least one adjustment peg.

14. The device according to claim 13, wherein said vertical support comprises a lockable cross member at the top of said vertical support; wherein said horizontal support is slidably connected to said lockable cross member.

15. The device according to claim 13, wherein said first-end magnet comprises a magnet within a soft enclosure, a surface of said magnet flush with or below a bottom outside surface of the soft enclosure.

16. The device according to claim 14, wherein said horizontal support is rotatably connected to said vertical support.

17. The device according to claim 13, wherein said ball comprises a metal rod through a diameter of said ball fully concealed beneath said ball's exterior surface.

18. The device according to claim 17, wherein said metal rod is comprised of two pieces of metal resistance welded together.

* * * * *